US011504841B2

(12) United States Patent
Howell et al.

(10) Patent No.: US 11,504,841 B2
(45) Date of Patent: Nov. 22, 2022

(54) SUPPORT STRUCTURE HAVING A TAMPER DETERRENT DESIGN

(71) Applicant: Bob Barker Company, Inc., Fuquay-Varina, NC (US)

(72) Inventors: Erin Paige Howell, Angier, NC (US); Lena Renee Butterfield, Apex, NC (US); Daniel Peter Burke, Apex, NC (US)

(73) Assignee: BOB BARKER COMPANY, INC., Fuquay-Varina, NC (US)

( * ) Notice: Subject to any disclaimer, the term of this patent is extended or adjusted under 35 U.S.C. 154(b) by 487 days.

(21) Appl. No.: 16/731,597

(22) Filed: Dec. 31, 2019

(65) Prior Publication Data

US 2020/0214433 A1 Jul. 9, 2020

Related U.S. Application Data

(60) Provisional application No. 62/787,813, filed on Jan. 3, 2019.

(51) Int. Cl.
*B25G 3/00* (2006.01)
*B25G 1/10* (2006.01)

(52) U.S. Cl.
CPC ..... *B25G 1/10* (2013.01); *A46B 2200/104* (2013.01); *A46B 2200/1066* (2013.01)

(58) Field of Classification Search
CPC .. A46B 5/00; A46B 9/023; A46B 9/04; A46B 2200/104; A46B 15/00; A46B 7/00; A46B 7/02; A46B 7/04; A46B 7/06; A46B 2200/00; A46B 2200/01; A46B 2200/1066; B25G 1/10; B25G 3/00
See application file for complete search history.

(56) References Cited

U.S. PATENT DOCUMENTS 3,067,446 A * 12/1962 Mcgauley ..... A46B 5/02 16/DIG. 12
3,188,672 A * 6/1965 Gary ..... A46B 5/0025 15/201

(Continued)

FOREIGN PATENT DOCUMENTS

CN 2596835 Y * 1/2004
CN 2807886 Y * 8/2006

OTHER PUBLICATIONS

No-Shank Products, "No-Shank General Population Toothbrush"; Retrieved from the internet: URL: https://no-shank.com/no-shank-products/ [retrieved on Mar. 19, 2020]; pp. 1-2.

(Continued)

*Primary Examiner* — Chuck Y Mah
(74) *Attorney, Agent, or Firm* — Coats & Bennett, PLLC

(57) ABSTRACT

An support structure of an article that has a tamper deterrent structure. The support structure, such as a handle, includes segments that are connected by a series of connectors. Both the segments and the connectors, on their own, are designed to prevent their use as a weapon. The connectors provide structure to the segments when the support structure is used as intended but are positioned so the support structure will fail upon intentional manipulation. This manipulation causes the support structure to break into smaller pieces in the event the support structure is attempted to be fashioned into or used as a weapon.

20 Claims, 5 Drawing Sheets

(56) References Cited

U.S. PATENT DOCUMENTS

| | | | | | |
|---|---|---|---|---|---|
| 4,159,182 | A * | 6/1979 | Adolfson | A47G 21/06 | D7/300.2 |
| 4,610,087 | A * | 9/1986 | Mickelson | B26B 3/00 | D7/650 |
| 5,272,784 | A * | 12/1993 | Levin | A46B 5/00 | 15/167.1 |
| 5,465,450 | A * | 11/1995 | Humphries | A46B 5/0079 | 15/201 |
| 5,778,478 | A * | 7/1998 | Coleman | A46B 5/0066 | 15/167.1 |
| 2007/0180640 | A1* | 8/2007 | Knopow | A46B 5/0025 | 15/210.1 |
| 2008/0000092 | A1* | 1/2008 | Vanguard | A47G 21/02 | 30/147 |
| 2012/0324664 | A1* | 12/2012 | Carpenter | A46B 1/00 | 15/143.1 |
| 2017/0007053 | A1* | 1/2017 | Challa | A47G 21/02 | |

OTHER PUBLICATIONS

Orabrite, "Orabrite Flexible Crossover Maximum Security Toothbrush"; Retrieved from the internet: URL: https://orabrite.net/Flexible-Crossover-Maximum-Security-Toothbrush [retrieved on Mar. 19, 2020]; pp. 1-2.

Orabrite, "Flexible Crossover Security Toothbrush, Compact Head"; Retrieved from the internet: URL: https://orabrite.net/Flexible-Crossover-Security-Toothbrush-4- [retrieved on Mar. 19, 2020]; pp. 1-2.

* cited by examiner

SUPPORT STRUCTURE HAVING A TAMPER DETERRENT DESIGN

RELATED APPLICATIONS

This application is claims the benefit of U.S. Provisional Application No. 62/787,813 filed Jan. 3, 2019, the disclosure of which is incorporated herein by reference in its entirety.

BACKGROUND

Articles such as but are not limited to personal care items such as toothbrushes, hairbrushes, combs, nail clippers and razors, utensils such as forks and spoons, mops, brooms, shower rods, trash cans, pencils, pens, eye glasses, chairs, and storage boxes are constructed to perform one or more functions. These articles include a support structure designed to be held and manipulated to support a functional element of the article, or to otherwise allow for the item to be used for its intended function.

These articles are used in facilities requiring security such as but not limited to jails, prisons, juvenile detention facilities, camps, rehab centers, and others facilities. An issue with using these articles in these secure facilities is the ability of a user to craft the support structure into a weapon. The user may sharpen the support structure into a point or sharpen an edge into a cutting or stabbing blade. The user is then able to grasp the support structure and use it as a weapon to potentially hurt others or themselves.

SUMMARY

One aspect is directed to a support structure to support a functional item of an article for use in a secure facility. The support structure comprises an interior section comprising interleaved and interconnected weak and strong subsections with the weak subsections having smaller breaking strengths than the strong subsections. The strong subsections are formed by segments that define outer lateral edges of the interior section. The weak subsections are formed at gaps between adjacent ones of the segments. A first end cap is connected to a first end of the interior section and spaced apart from the interior section by a first end gap. A second end cap is connected to a second end of the interior section and spaced apart from the interior section by a second end gap. The interior section is configured to break at one or more of the weak subsections when a force above a predetermined amount is applied to the support structure.

In another aspect, the strong subsections comprise a larger cross-sectional size than the weak subsections.

In another aspect, the weak subsections comprise one or more connectors that extend between adjacent ones of the segments.

In another aspect, each of the strong subsections is connected to an adjacent strong subsection at two locations.

In another aspect, each of the weak subsections comprise a gap that extends between adjacent ones of the strong subsections, and one or more connectors that extend between the adjacent one of the strong subsections.

In another aspect, at least two of the gaps comprise different lengths measured along a longitudinal axis of the interior section.

In another aspect, bristles are connected to one or more of the stronger sections to form a brush.

In another aspect, the support structure comprises a unitary one-piece construction.

In another aspect, two or more of the strong subsections comprise different breaking strengths.

One aspect is directed to a support structure to support a functional item of an article for use in a secure facility. The support structure comprises an interior section having a first length with the interior section comprising: a plurality of segments disposed in series and spaced apart from adjacent ones of the segments by gaps, wherein each of the segments has a gap on each opposing side; a plurality of connectors aligned transverse to the segments, wherein each of the connectors connects together two or more but not all of the segments and with each of the gaps bridged by one or more of the connectors; wherein the gaps are weaker than the segments to cause the interior section to break at one or more of the gaps when a force above a predetermined amount is applied to the support structure. A first end member is positioned at a first end of the interior section and spaced apart from the interior section by a first end gap and with at least one of the connectors extending across the first end gap to connect the first end member to the interior section. A second end member is positioned at a second end of the interior section and spaced apart from the interior section by a second end gap and with at least one of the connectors extending across the second end gap to connect the second end member to the interior section.

In another aspect, the gaps comprise an equal size along the interior section with the segments equally spaced apart.

In another aspect, at least two of the plurality of connectors that are positioned along different sections of the interior section are offset along a longitudinal axis of the interior section.

In another aspect, each of the segments comprises a cross-sectional area that is larger than each of the adjacent plurality of connectors.

In another aspect, two of the connectors extend across each of the gaps of the interior section.

In another aspect, each of the connectors connects together just two of the segments.

One aspect is directed to a support structure to support a functional item of an article for use in a secure facility. The support structure comprises a plurality of segments that extend along an interior section with each of the segments spaced apart from adjacent ones of the segments by a gap. A plurality of connectors connect together the plurality of segments with each of the segments connected to a first adjacent segment by one or more first connectors and connected to a second adjacent segment by one or more second connectors. The connectors comprise a smaller sectional size than the segments.

In another aspect, a first end member is positioned at a first end of the plurality of segments with the first end member spaced apart from the first end by a first end gap and with at least one of the connectors extending across the first end gap to connect the first end member to the first end, and a second end member positioned at a second end of the plurality of segments with the second end member spaced apart from the second end by a second end gap and with at least one of the connectors extending across the second end gap to connect the second end member to the second end.

In another aspect, the segments define outer lateral edges of the support structure.

In another aspect, at least two of the connectors that extend along different sections of the support structure are offset from one another along a longitudinal axis of the support structure.

One aspect is directed to a support structure with a tamper deterrent design. The support structure includes segments that are spaced apart along a length of the support structure. Connectors connect together a subset of the segments. The connectors provide structure to the segments when the support structure is used as intended but are configured to fail upon intentional manipulation.

In another aspect, the connectors fail when a force above a predetermined amount is applied to the support structure.

In another aspect, the segments have a larger sectional area than the connectors.

In another aspect, the support structure has a unitary one-piece construction that includes the connectors and the segments.

In another aspect, the connectors connect together just a pair of adjacent segments.

Another aspect is directed to a break away support structure that includes segments that are aligned along a length of the support structure. The segments are spaced apart from adjacent segments by a gap. Connectors extend across the gap and connect together adjacent segments. The connectors have a smaller sectional size than the segments. Each of the segments is connected to a first adjacent segment by one or more first connectors, and is connected to a second adjacent segment by one or more second connectors.

In another aspect, each of the first and second connectors connects together just two of the segments.

In another aspect, the connectors and segments have a unitary one-piece construction.

Another aspect is directed to a break away support structure that includes segments aligned along a length of the support structure. The segments are spaced apart from adjacent segments by a gap. Connectors extend across the gap and connect together just adjacent segments. The connectors have a smaller sectional size than the segments. Each of the segments is connected to a first adjacent segment by one or more first connectors and connected to a second adjacent segment by one or more second connectors.

DETAILED DESCRIPTION

The present application is directed to a support structure having a tamper deterrent design. The support structure includes segments that are connected by a series of connectors. Both the segments and the connectors, on their own, are designed to prevent their use as a weapon. The connectors provide structure to the segments when the article is used as intended but are positioned so the support structure will fail upon intentional manipulation. This manipulation causes the support structure to break into smaller pieces in the event the support structure is attempted to be fashioned into or used as a weapon.

Figure 1:
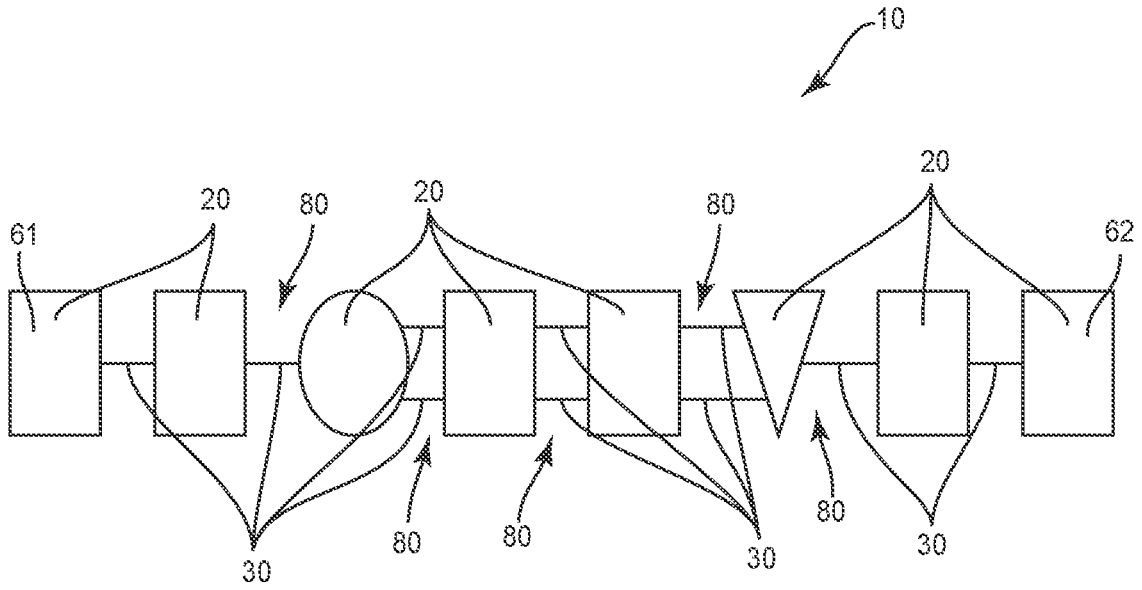
FIG. 1 is a schematic view of a support structure.
Figure 2:
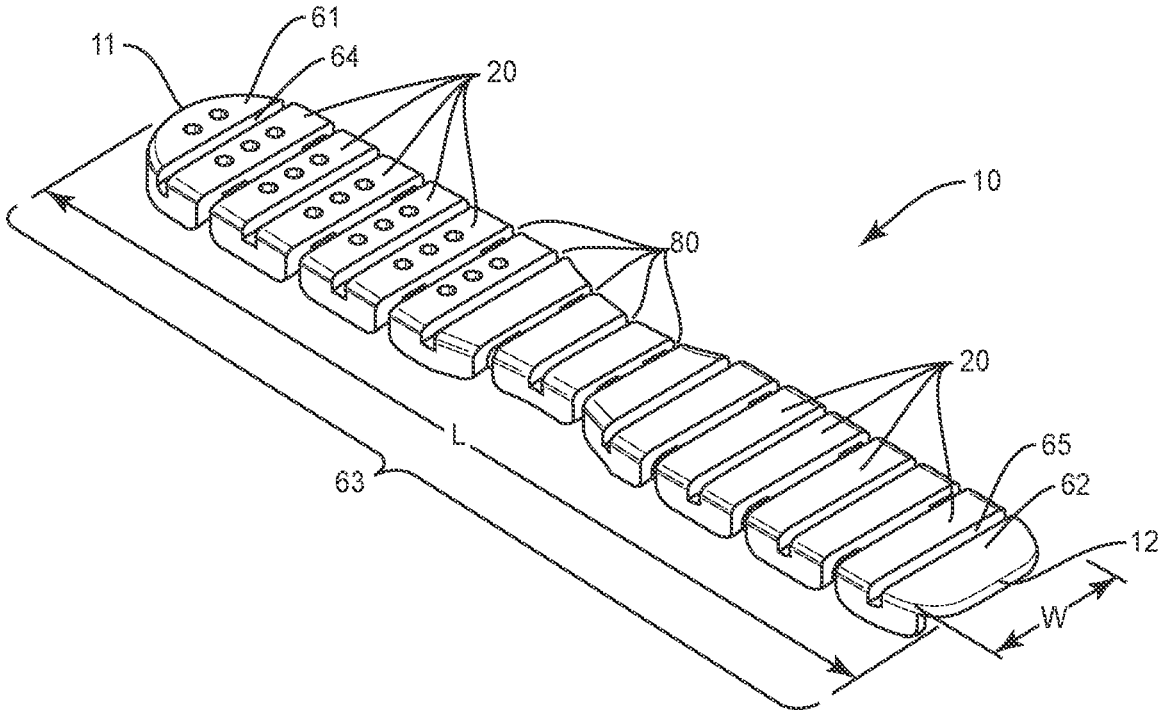
FIG. 2 is a perspective view of a support structure.
Figure 3:
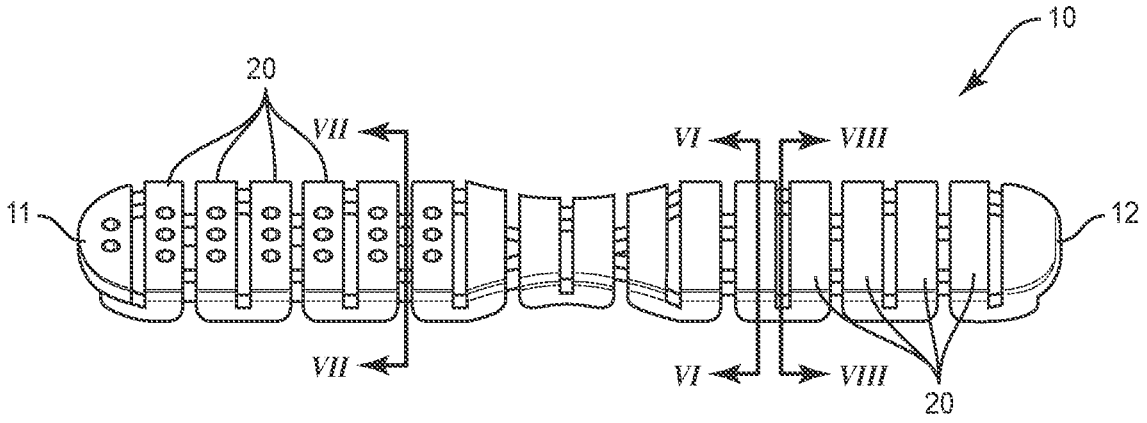
FIG. 3 is a perspective view of a first side of the support structure of FIG. 2.
Figure 4:
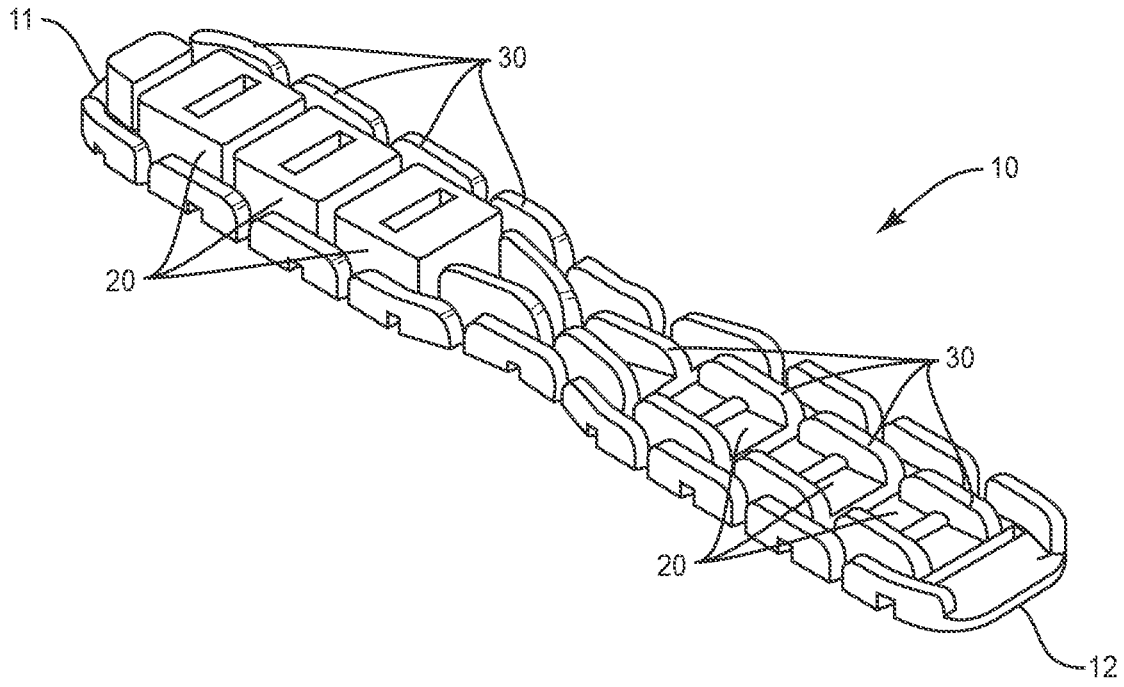
FIG. 4 is a perspective view of a second side of the support structure of FIG. 2.

The tamper deterrent support structures 10 can be utilized in a variety of different articles. Examples include but are not limited to toothbrushes, hairbrushes, combs, nail clippers, razors, forks, spoons, mops, brooms, shower rods, trash cans, pencils, pens, eye glasses, chairs, and storage boxes. In one example, the support structure 10 is a handle that supports various functional items. FIG. 1 schematically illustrates one example of the support structure 10. The support structure 10 has an elongated shape to facilitate its use (e.g., held by the user while brushing their teeth, brushing their hair, eating, sweeping the floor, etc.). The support structure 10 includes segments 20 that are connected together by connectors 30. The connectors 30 are structurally adequate for the support structure 10 to function for its intended purpose. In the event the support structure 10 is intentionally manipulated, one or more of the connectors 30 will fail. This results in the support structure 10 breaking into two or more smaller pieces that could not be used as a weapon.

FIGS. 2-5 illustrate one design of a support structure 10 being a handle for a toothbrush. The support structure 10 includes an elongated length L measured between a first end 11 and a second end 12. Segments 20 are spaced apart along the length. The segments 20 can include the same or different shapes and/or sizes. In the support structure 10 of FIGS. 2-5, the segments 20 towards the first and second ends 11, 12 have substantially the same shape and size. Segments 20 towards the middle of the support structure 10 include a smaller width W.

The segments 20 are spaced apart by gaps 80. The gaps 80 can include the same or different sizes. FIGS. 2-5 include the gaps 80 being the same size such that the segments 20 along the length of the support structure 10 are equally spaced apart. Other designs include the gaps 80 being different such that the spacing of the segments 20 varies along the length L of the support structure 10. One or more of the gaps 80 can be exposed along the outer lateral edges of the support structure 10. In another example, one or more of the gaps 80 are positioned within an interior of the support structure 10 and are not exposed at the outer lateral edges.

Figure 5:
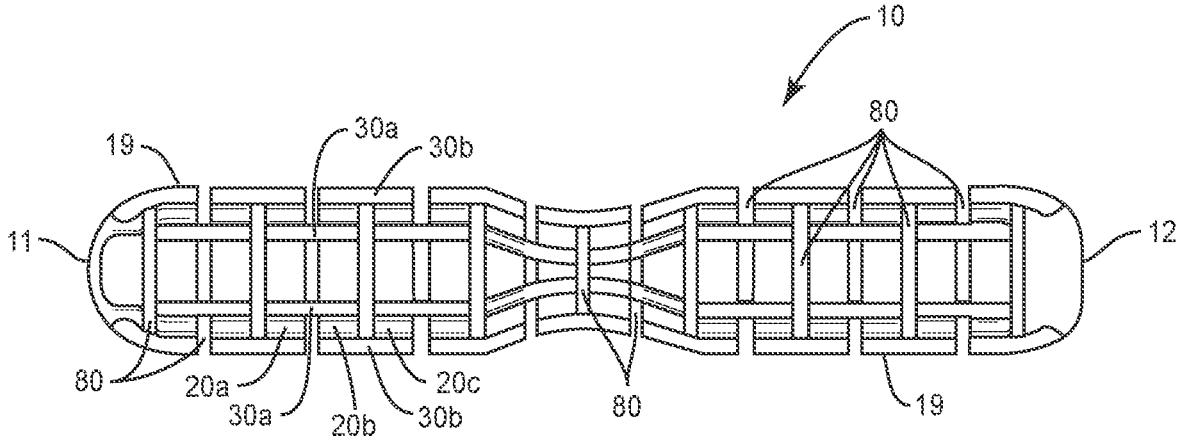
FIG. 5 is a plan view of the second side of the support structure of FIG. 2.

The connectors 30 extend across the gaps 80 and connect together adjacent segments 20. Each connector 30 includes a length to connect a limited number of segments 20. FIG. 5 includes the connectors 30*a*, 30*b* with a length to connect together just two adjacent segments 20. For example, connectors 30*a* extend along just segments 20*a* and 20*b*, and connectors 30*b* extend along just one of segments 20*b* and 20*c*.

The connectors 30 can extend across the entire length of the segments 20 as illustrated in FIG. 5. Other designs include the connectors 30 extending across a limited length of the segments 20. For example, connector 30*c* of FIG. 10 extends across a limited section of each of connectors 20*c*, 20*d*.

Figure 10:
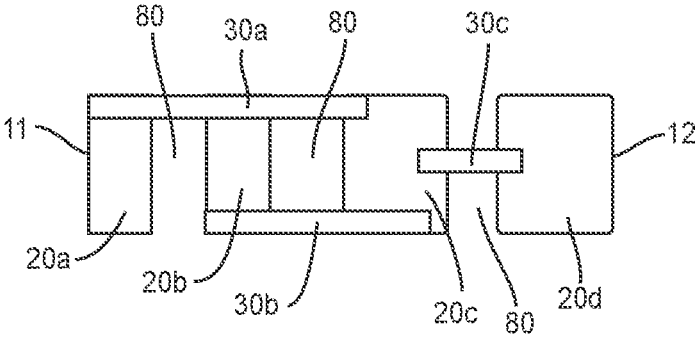
FIG. 10 is a schematic view of a support structure.

Each segment 20 is connected to an adjacent segment 20 by one or more connectors 30. For example as illustrated in FIG. 5, segment 20*b* is connected to adjacent segment 20*a* by a pair of connectors 30*a*. In addition, segment 20*b* is connected to the opposing adjacent segment 20*c* by a different pair of connectors 30*b*. This pattern continues along the length of the support structure 10. Other designs can include different connection patterns. FIG. 10 includes connector 30*a* connecting segments 20*a*, 20*b*, and 20*c*, connector 30*b* connecting segments 20*b* and 20*c*, and connector 30*c* connecting segments 20*c* and 20*d*.

The support structure 10 includes a first end cap 61 and a second end cap 62. An interior section 63 is positioned between the end caps 61, 62. One or more connectors 30 connect the first end cap 61 to the interior section 63, and one or more connectors 30 connect the second end cap 62 to the interior section 63. The first end cap 61 is spaced apart from the interior section 63 by a first end gap 64. The second end cap 62 is spaced apart from the interior section by a second end gap 65. The end gaps 64, 65 can be the same shape and/or size as the other gaps 80 along the interior section 63.

The connectors 30 can be positioned along the width W inward from the outer edges 19 of the support structure 10. Thus, the gaps 80 are exposed along the outer edges 19. This positioning minimizes the length of a continuous section of the outer edge 19. The continuous sections are not long enough to be sharpened into a cutting edge as could occur with a more continuous edge design. This prevents or reduces the ability of the support structure 10 being fashioned into a weapon.

The support structure 10 can have an integral one-piece construction. One design includes the support structure 10 being a molded one-piece member. The support structure 10 can also be constructed from two or more sections that are connected together. The support structure 10 can be constructed from various materials, including but not limited to polypropylene, silicone, nylon, and thermoplastic rubber (TPR).

The interior section 63 of the support structure includes the segments 20 disposed in series along the length L. The segments 20 are spaced apart from adjacent segments 20 by gaps 80. Each of the segments 20 has a gap 80 on each opposing side.

The connectors 30 connect together the segments 20 along the interior section 63. The connectors 30 are aligned transverse to the segments 20. A number of connectors 30 extend along the length of the interior section 63. The connectors 30 can be positioned at different spacings across the width to not align. As illustrated in FIG. 10, connectors 30*a* and 30*c* are offset at different spacings across the width.

Figure 6:
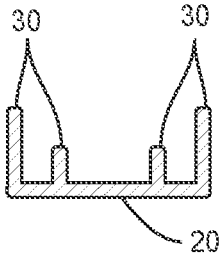
FIG. 6 is a sectional view cut along line VI-VI of FIG. 3.
Figure 7:
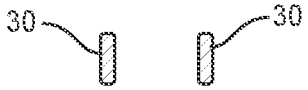
FIG. 7 is a sectional view cut along line VII-VII of FIG. 3.
Figure 8:
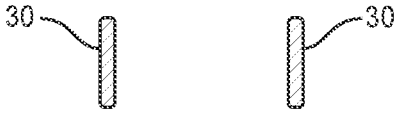
FIG. 8 is a sectional view cut along line VIII-VIII of FIG. 3.

The connectors 30 provide structure to the segments 20 which fail upon the intentional manipulation on the support structure 10. The segments 20 can include a larger sectional area than the connectors 30 and thus be stronger. That is, the gaps 80 with the one or more connectors 30 include smaller breaking strengths than the segments 20. As illustrated in FIGS. 6, 7, and 8, the sectional area of the segment 20 (FIG. 6) is larger than the sectional areas of the connectors 30 (FIGS. 7 and 8). The sectional areas of the various segments 20 and connectors 30 can vary or can be the same along the length of the support structure 10.

Another design includes one or more of the connectors 30 constructed from different material than the segments 20. This different material results in the one or more connectors 30 being weaker and thus failing upon the application of an excessive force above a predetermined amount.

The different weaker sections between the segments 20 that are formed by the one or more connectors 30 can include different breaking strengths. For example, a first weak section can be formed by a single connector 30 and have a lesser breaking strength than a second weak section formed by two connectors 30.

Figure 9:
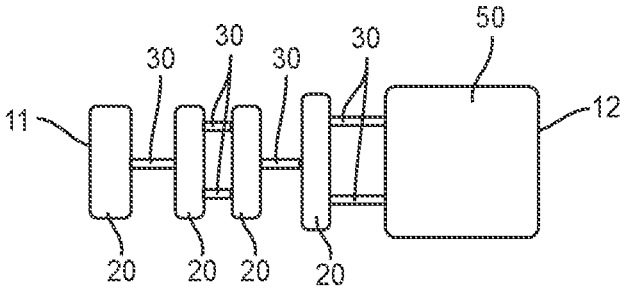
FIG. 9 is a schematic view of a support structure.

The entire length of the support structure 10 can include a construction of segments 20 and connectors 30 as illustrated in FIGS. 2-5. Support structures 10 can also include limited sections with the segment 20 and connector 30 construction. FIG. 9 includes a support structure 10 with segments 20 and connectors 30 extending along a limited length. A non-tamper deterrent section 50 forms one end of the support structure 10. In one design, the non-tamper deterrent section 50 provides a mount for bristles, razor, spoon head, fork head, etc.

One or more segments 20 can be configured to receive a functional item. This can include but is not limited to openings to receive bristles for a brush, a flange to receive a housing for a razor, and a narrow neck to receive a head of a spoon or a head of a broom.

As illustrated in FIG. 1, the support structure 10 includes weak subsections formed at the gaps 80 by the one or more connectors 30 that span across the gaps 80. The support structure 10 also includes strong subsections formed at the segments 20. The weak subsections are not as strong and therefore will break when a force above a predetermined amount is applied to the support structure 10. In one example, this force occurs when the support structure 10 is used as a weapon to stab, cut, or otherwise be thrust at another person with the intent to injure the other person. The weak and strong sections are interleaved along the length of the support structure 10. The weak and strong section are also interconnected along the length. End caps 61, 62 are connected to the weak and strong subsections. Each end cap 61, 62 is spaced apart by a gap.

The design of the support structure 10 provides for the interior section 63 to be frangible to cause the support structure 10 to break into two or more different sections in the event a force above a predetermined amount is applied to the support structure 10. For example, if a person attempts to use the support structure 10 as a weapon, the support structure 10 will break at one or more of the gaps 80 because the gaps 80 include smaller breaking strengths than the segments 20.

The design of the support structure 10 deters a person from attempting to make a weapon. Manipulation of the support structure 10 to create a weapon includes removing material from one or more of the edges. For example, one or both lateral sides at one of the end caps 61, 62 can be filed down in an attempt to create a point. However, the end caps 61, 62 and the interior segments 20 are relatively small in size. Creating a weapon would require the manipulation of two or more of the end caps 61, 62 and/or segments 20. However, this amount of manipulation would result in severing one or more of the connectors 30 thus causing the support structure to break into multiple pieces and/or lose its elongated shape. If a user were to try to manipulate the segments 20 and end caps 61, 62 without severing one or more of the connectors 30, not enough material would be removed to craft an effective weapon.

Figure 11:
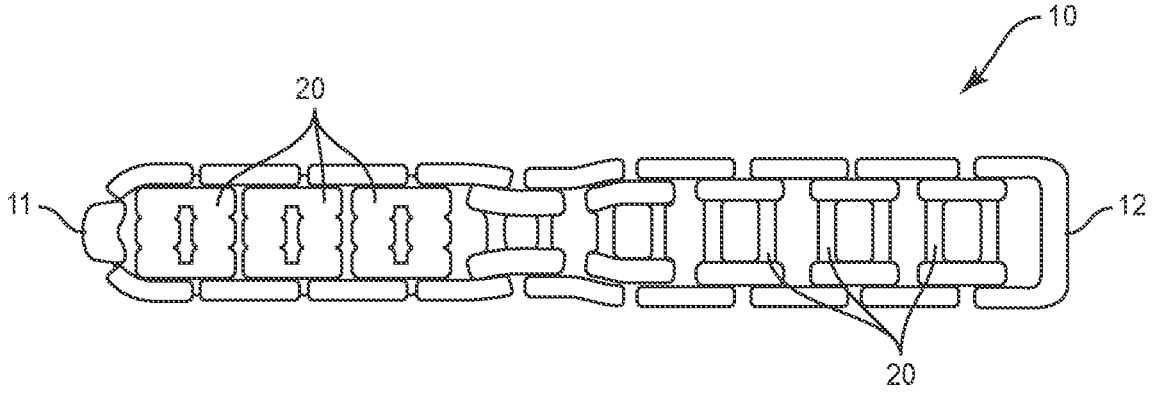
FIG. 11 is a plan view of a second side of a support structure.
Figure 12:
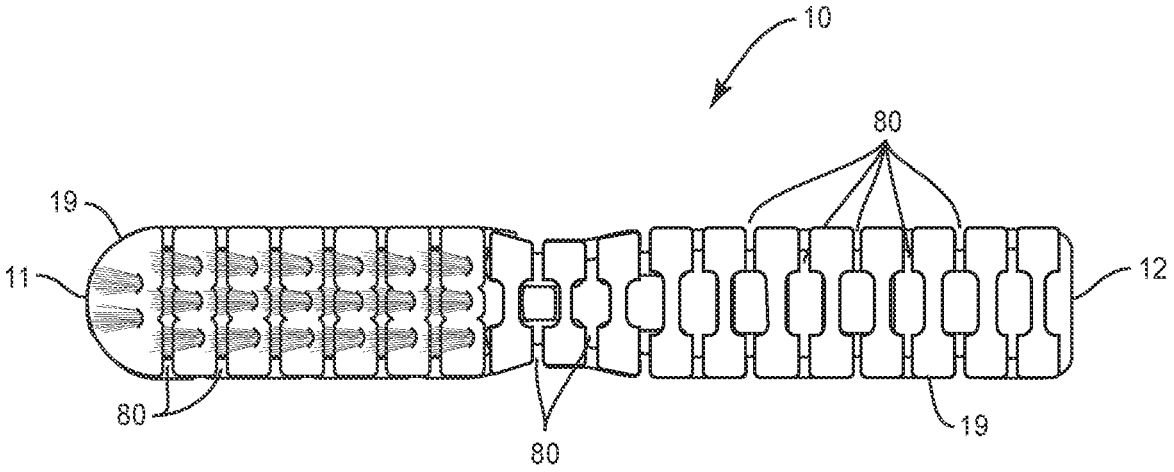
FIG. 12 is a plan view of a first side of a support structure.

FIG. 11 illustrates a bottom view of another example of a support structure 10. FIG. 12 illustrates a top view of a support structure 10. In these examples, the segments 20 have been reduced in size with the gaps 80 being enlarged. The smaller segment size makes it more difficult to craft a weapon. Further, the smaller size uses less material thus decreasing the cost of manufacturing.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive.

What is claimed is:

1. A support structure to support a functional item of an article for use in a secure facility, the support structure comprising:

an interior section comprising:

interleaved and interconnected weak and strong subsections, the weak subsections having smaller breaking strengths than the strong subsections;

the strong subsections formed by segments that define outer lateral edges of the interior section;

the weak subsections formed at gaps between adjacent ones of the segments;

a first end cap connected to a first end of the interior section and spaced apart from the interior section by a first end gap;

a second end cap connected to a second end of the interior section and spaced apart from the interior section by a second end gap; and the interior section is configured to break at one or more of the weak subsections when a force above a predetermined amount is applied to the support structure.

2. The support structure of claim 1, wherein the strong subsections comprise a larger cross-sectional size than the weak subsections.

3. The support structure of claim 2, wherein the weak subsections comprise one or more connectors that extend between adjacent ones of the segments.

4. The support structure of claim 1, wherein each of the strong subsections is connected to an adjacent strong subsection at two locations.

5. The support structure of claim 1, wherein each of the weak subsections comprise a gap that extends between adjacent ones of the strong subsections, and one or more connectors that extend between the adjacent one of the strong subsections.

6. The support structure of claim 5, wherein at least two of the gaps comprise different lengths measured along a longitudinal axis of the interior section.

7. The support structure of claim 1, further comprising bristles connected to one or more of the stronger sections to form a brush.

8. The support structure of claim 1, wherein the support structure comprises a unitary one-piece construction.

9. The support structure of claim 1, wherein two or more of the strong subsections comprise different breaking strengths.

10. A support structure to support a functional item of an article for use in a secure facility, the support structure comprising:

an interior section having a first length, the interior section comprising:

a plurality of segments disposed in series and spaced apart from adjacent ones of the segments by gaps, wherein each of the segments has a gap on each opposing side;

a plurality of connectors aligned transverse to the segments, wherein each of the connectors connects together two or more but not all of the segments and with each of the gaps bridged by one or more of the connectors;

wherein one or more of the connectors are spaced inward along a width from edges of the segments to form jagged outer lateral edges along the interior section;

wherein the gaps are weaker than the segments to cause the interior section to break at one or more of the gaps when a force above a predetermined amount is applied to the support structure;

a first end member positioned at a first end of the interior section and spaced apart from the interior section by a first end gap and with at least one of the connectors extending across the first end gap to connect the first end member to the interior section; and a second end member positioned at a second end of the interior section and spaced apart from the interior section by a second end gap and with at least one of the connectors extending across the second end gap to connect the second end member to the interior section.

11. The support structure of claim 10, wherein the gaps comprise an equal size along the interior section with the segments equally spaced apart.

12. The support structure of claim 10, wherein at least two of the plurality of connectors that are positioned along different sections of the interior section are offset along a longitudinal axis of the interior section.

13. The support structure of claim 10, wherein each of the segments comprises a cross-sectional area that is larger than each of the adjacent plurality of connectors.

14. The support structure of claim 10, wherein two of the connectors extend across each of the gaps of the interior section.

15. The support structure of claim 10, wherein each of the connectors connects together just two of the segments.

16. A support structure to support a functional item of an article for use in a secure facility, the support structure comprising:

a plurality of segments that extend along an interior section, each of the segments spaced apart from adjacent ones of the segments by a gap;

a plurality of connectors that connect together the plurality of segments, each of the segments connected to a first adjacent segment by one or more first connectors and connected to a second adjacent segment by one or more second connectors;

wherein one or more of the connectors extends across portions of at least the first adjacent segment and the second adjacent segment;

wherein the connectors comprise a smaller sectional size than the segments.

17. The support structure of claim 16, further comprising:

a first end member positioned at a first end of the plurality of segments, the first end member spaced apart from the first end by a first end gap and with at least one of the connectors extending across the first end gap to connect the first end member to the first end; and a second end member positioned at a second end of the plurality of segments, the second end member spaced apart from the second end by a second end gap and with at least one of the connectors extending across the second end gap to connect the second end member to the second end.

18. The support structure of claim 16, wherein the segments define the outer lateral edges of the support structure.

19. The support structure of claim 16, wherein at least two of the connectors that extend along different sections of the support structure are offset from one another along a longitudinal axis of the support structure.

20. The support structure of claim 16, wherein the connectors are positioned inward along a width from the segments to minimize a continuous section of an outer lateral edge.

* * * * *